US008510981B1

(12) United States Patent
Ganther et al.

(10) Patent No.: US 8,510,981 B1
(45) Date of Patent: Aug. 20, 2013

(54) DROOP-RESISTANT STEMS AND ADAPTERS FOR BORESIGHTING WEAPONS

(75) Inventors: Christopher Paul Ganther, Stuart, FL (US); Stephen Raymond Teklinski, Loxahatchee, FL (US); Steven F. Teklinski, Jupiter, FL (US)

(73) Assignee: Graflex, Inc., Jupiter, FL (US)

( * ) Notice: Subject to any disclaimer, the term of this patent is extended or adjusted under 35 U.S.C. 154(b) by 0 days.

(21) Appl. No.: 13/596,791

(22) Filed: Aug. 28, 2012

(51) Int. Cl.
*F41G 1/38* (2006.01)

(52) U.S. Cl.
USPC ..... 42/121

(58) Field of Classification Search
USPC ..... 42/116, 121, 134
See application file for complete search history.

(56) References Cited

U.S. PATENT DOCUMENTS

| | | | | | |
|---|---|---|---|---|---|
| 2,860,972 | A | * | 11/1958 | Fraser | 420/429 |
| 4,534,116 | A | | 8/1985 | Davis | |
| 4,750,269 | A | * | 6/1988 | Townsend et al. | 42/121 |
| 4,825,258 | A | * | 4/1989 | Whitson | 356/153 |
| 5,396,708 | A | * | 3/1995 | Whitley | 42/121 |
| 5,486,913 | A | * | 1/1996 | Aharon | 356/153 |
| 5,694,202 | A | | 12/1997 | Mladjan et al. | |
| 6,295,753 | B1 | * | 10/2001 | Thummel | 42/116 |
| 6,397,509 | B1 | * | 6/2002 | Langner | 42/116 |
| 6,421,947 | B1 | * | 7/2002 | Fuller | 42/116 |
| 6,810,615 | B2 | | 11/2004 | Hermanson et al. | |
| 7,265,944 | B1 | | 9/2007 | Coon et al. | |
| 2007/0144051 | A1 | * | 6/2007 | Moore et al. | 42/116 |
| 2007/0169392 | A1 | * | 7/2007 | Davis | 42/116 |
| 2009/0260270 | A1 | * | 10/2009 | Wu | 42/133 |
| 2012/0167440 | A1 | * | 7/2012 | StPhillips et al. | 42/116 |

OTHER PUBLICATIONS

"The Stress-Strain Curve", Duke University, Jun. 27, 2003, http://delbow.cee.duke.edu/TENSILE/tutorial/node4.html.
"Civil Engineering Bulletin, References for Young Modulus—Modules of Elasticity", Sep. 14, 2011, http://cebulletin.com/article/FreeCETools/444.

* cited by examiner

*Primary Examiner* — Bret Hayes
(74) *Attorney, Agent, or Firm* — Jetter & Associates, P.A.

(57) ABSTRACT

A stem or adapter for boresighting weapons includes a first portion having a weapon insertion end including a centering device including a plurality of fingers which compress upon insertion into a bore of a weapon. A second portion has a first end attached to an end of the first portion opposite to the weapon insertion end. The second portion has a coupling end including an attachment feature opposite the first end for attaching another member thereto. The second portion is largely tungsten carbide, and the first portion is formed from a material that is largely not tungsten carbide to provide sufficient flexibility to allow the fingers to spring load when inserted into the bore of the weapon.

14 Claims, 3 Drawing Sheets

DROOP-RESISTANT STEMS AND ADAPTERS FOR BORESIGHTING WEAPONS

FIELD

Disclose embodiments relate to boresights for zeroing (collimating or boresighting) of weapons, and more specifically to stems and adapters, which are inserted into the bore of the weapon for mounting a boresight apparatus for zeroing the weapon.

BACKGROUND

Boresighting is an alignment process (collimation) by which the weapon's bore centerline and gunner's optical sighting system are referred to the same aiming point. The stem or adapter (or mandrel) is the portion of the boresight device that includes a weapon insertion end which during boresighting is inserted into the bore of the weapon.

The stem or adapter generally includes a centering device which comprises plurality of flexible "fingers" that are typically equiangularly spaced about the axis of the barrel on the weapon insertion. Upon insertion into the bore of the weapon, the fingers compress within the weapon's bore and exert an outward restoring spring force to locate and secure the stem or adapter in essentially the exact center of the weapon's bore. Proper centering is known to be needed for boresighting accuracy.

Traditional stems and adapters comprise materials which provide strength as well as the required flexibility for spring action of the fingers upon insertion, such as stainless steel, stainless steel alloys, or aluminum. A boresight apparatus for zeroing the weapon is mounted on the other end of the stem or adapter so that it is positioned coaxial with the axis of the stem or adapter, such as a boresighting telescope, laser, or other zeroing device. In the case of a boresighting telescope, the boresighting telescope is positioned coaxial with the axis of the shaft of the stem or adapter, and in operation a sight may be made along the axis of the shaft to a calibration target.

SUMMARY

This Summary is provided to introduce a brief selection of disclosed concepts in a simplified form that are further described below in the Detailed Description including the drawings provided. This Summary is not intended to limit the claimed subject matter's scope.

Disclosed embodiment recognize the "stem" or an "adapter" on a stem for boresighting a weapon supports the full weight of the optical telescope, laser, or other boresighting/zeroing device, and for proper boresighting accuracy should not measurably flex, deflect or otherwise droop from the bore centerline, including over time due to repeated use. It has been discovered by the Inventors conventional stems and adapters which generally are formed from steel (e.g., stainless steel) or aluminum are generally not sufficiently durable to withstand repeated cycles of insertion and removal from the bore of a weapon without measurably drooping from the bore centerline. Although conventional boresighting largely ignores the stem and adapter with regard to boresighting accuracy, and instead focuses on improving the boresighting/zeroing device, disclosed embodiments recognize the stem and adapter can be an important factor in determining the accuracy of a boresight apparatus, particularly over a period of time that involves repeated use thereof.

To help prevent a stem or an adapter from drooping due to the weight of the boresight telescope when inserted into the barrel of the weapon, disclosed embodiments add at least one droop-resistant portion comprising largely (by weight) tungsten carbide. As used herein, the droop-resistant portion comprising largely tungsten carbide can apply to either a stem which refers to an article which is threaded directly into the boresight telescope, or an adapter which fits on the taper of the stem, and then fits a different caliber which can be larger, or smaller as compared to the caliber of the stem. For example, stems can range from 5.56 mm to 7.62 mm, and adapters can range from 5.56 mm to above 40 mm.

Disclosed stems and adapters resist droop by including a droop-resistant portion comprising largely (by weight) tungsten carbide which is secured to another portion including its weapon insertion end which comprises a material that is largely not tungsten carbide, which generally does not include any tungsten carbide. The weapon insertion end provides conventional flexible fingers that in operation are compressed within the weapon's bore which exert a spring force to locate the adapter in essentially the center of the bore of the weapon. Disclosed embodiments also recognize tungsten carbide being highly rigid does not have the flexibility needed to provide the needed spring loaded function. As used herein, the term "largely tungsten carbide" is defined to be a material that includes at least 70 wt. % tungsten carbide, while other portion disclosed to be primarily formed from other materials, such as being primarily steel or aluminum, is similarly defined herein to be a material that includes at least 70 wt. % of the other material(s).

Pure tungsten carbide is known in the material arts to be an inorganic chemical compound containing equal numbers of tungsten atoms and carbon atoms, and is extremely hard (8.5-9.0 Mohs scale, Vickers hardness number=2242). Having a largely tungsten carbide coupling end has been found to significantly reduce the droop, so that the useful life of the stem or adapter determined by boresighting accuracy can be extended. For example, the useful life of disclosed stems and adapters may be as much as ten times greater as compared conventional stems and adapters, such as those consisting essential of stainless steel or aluminum throughout.

BRIEF DESCRIPTION OF THE DRAWINGS

FIG. 4A is a depiction of an example boresighting arrangement comprising the article shown in FIG. 3 integrated with a boresight telescope, where the article is locked in place with a droop-resistant adapter that is inserted into the bore of a weapon, for boresighting generally medium to larger caliber weapons, according to an example embodiment, while

DETAILED DESCRIPTION

Figure 1:
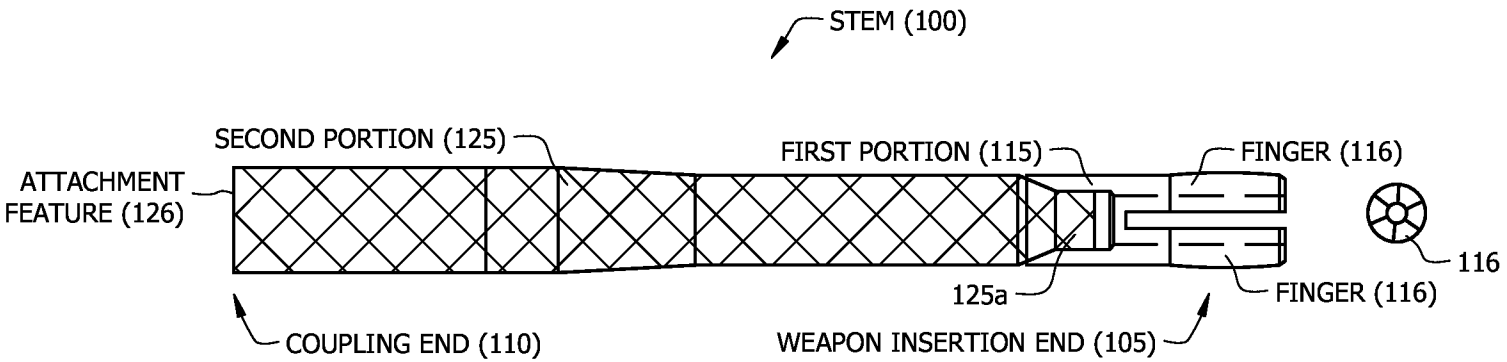
FIG. 1 is a see-through depiction of an example two-piece droop-resistant stem for boresighting weapons according to an example embodiment.

Disclosed embodiments in this Disclosure are described with reference to the attached figures, wherein like reference numerals are used throughout the figures to designate similar or equivalent elements. The figures are not drawn to scale and they are provided merely to illustrate the disclosed embodiments. Several aspects are described below with reference to example applications for illustration. It should be understood that numerous specific details, relationships, and methods are set forth to provide a full understanding of the disclosed embodiments. One having ordinary skill in the relevant art, however, will readily recognize that the subject matter disclosed herein can be practiced without one or more of the specific details or with other methods. In other instances, well-known structures or operations are not shown in detail to avoid obscuring structures or operations that are not well-known. This Disclosure is not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

FIG. 1 shows a depiction of an example two-piece droop-resistant stem 100 having a first portion 115 including a weapon insertion end 105 for insertion into the bore of a weapon and a second portion 125 including a coupling end 110 opposite the weapon insertion end 105 for directly or indirectly (e.g., through an adapter) attaching a boresight apparatus for zeroing the weapon. The first portion 115 of stem 100 has a plurality of flexible fingers 116 which compress upon insertion into the bore of the weapon to provide spring loading. The inset provided shows a cross sectional depiction showing of a plurality of flexible fingers 116, with six (6) flexible fingers 116 shown equiangularly spaced only as an example.

The second portion 125 of stem 100 comprises largely tungsten carbide having a first end 125*a* that has a reduced dimension as compared to other locations of the second portion 125, which is attached to the end of the first portion 115 opposite the weapon insertion end 105 as shown. The second portion 125 also includes an attachment feature 126 on its coupling end 110 for attaching an adapter or for attaching a boresight apparatus for zeroing the weapon. The attachment feature 126 can comprise machine threading (not shown). The first portion 115 and second portion 125 can be attached by a joining process, such as by press fitting, welding, or soldering (e.g., silver soldering).

The first portion 115 comprises a material that is largely not tungsten carbide based on the Inventors' recognition tungsten carbide being highly rigid does not have the flexibility needed to provide the needed spring loaded function. The first portion 115 can comprise largely, if not essentially entirely, traditional adapter materials such as aluminum, steel, or stainless steel alloys. For example, the steel can comprise 17-4 stainless steel, which can be heat treated and then chrome plated for the first portion 115, or other non-largely tungsten carbide portions of disclosed adapters (e.g., see the optional third portion/adapter 250 described relative to FIG. 2).

As noted above, the term "largely tungsten carbide" as used herein is a material that includes at least 70 wt. % tungsten carbide, and is typically at least 80 wt. % tungsten carbide. In one particular embodiment, the tungsten carbide material is >99% by weight tungsten carbide.

For example, disclosed tungsten carbide can include cobalt in a concentration from 1 wt. % up to about 20 wt. %. In this embodiment the tungsten carbide grains are held together by cobalt which acts as a binder. Another binder that can be used for tungsten carbide is nickel. Increasing the cobalt or nickel content provides a softer grade that is more impact resistant. Other materials may also be included, such as titanium tungsten carbide and tantalum tungsten carbide.

As known in the material arts, tungsten carbide is a highly rigid material. Tungsten carbide compositions generally range in rigidity from two to three times that of steel, and four to six times as rigid as compared to cast iron or brass. The Young's Modulus of tungsten carbide is up to 94,800,000 psi. Tungsten carbide provides high resistance to deformation and deflection which is recognized by disclosed embodiments as being valuable for boresighting where a combination of minimum deflection and good ultimate strength is important to resist droop. Regarding strength, tungsten carbide also has very high strength, particularly for a material so hard and rigid. Compressive strength is higher than virtually all melted and cast or forged metals and alloys. Moreover, regarding dimensional stability, tungsten carbide undergoes no phase changes during even elevated heating and cooling and retains its stability over long periods of time, without the need for heat treating.

Tungsten carbide grain size may also be used as a design parameter for disclosed adaptors, with very fine grain tungsten carbides (<2μ in size) providing the highest hardness, and thus the best droop resistance. For example, sub-micron grains are typically much more uniform in size and hence generally provide improved hardness as well as increased strength as compared to larger grain sizes. However, the tungsten carbide grain size can generally range from about 0.2 microns to about 50 microns.

As described above, the second portion 125 comprising largely tungsten has been found to significantly reduce the droop effect. The useful life of disclosed adapters may be extended as much as ten (10) times beyond conventional stainless steel adapters.

Disclosed stems and adapters are generally used with small arms weapons, having calibers from 5.56 mm to 70 mm. For example, the small arms weapon can comprise a rifle, a machine gun, grenade launcher, etc.

Figure 2:
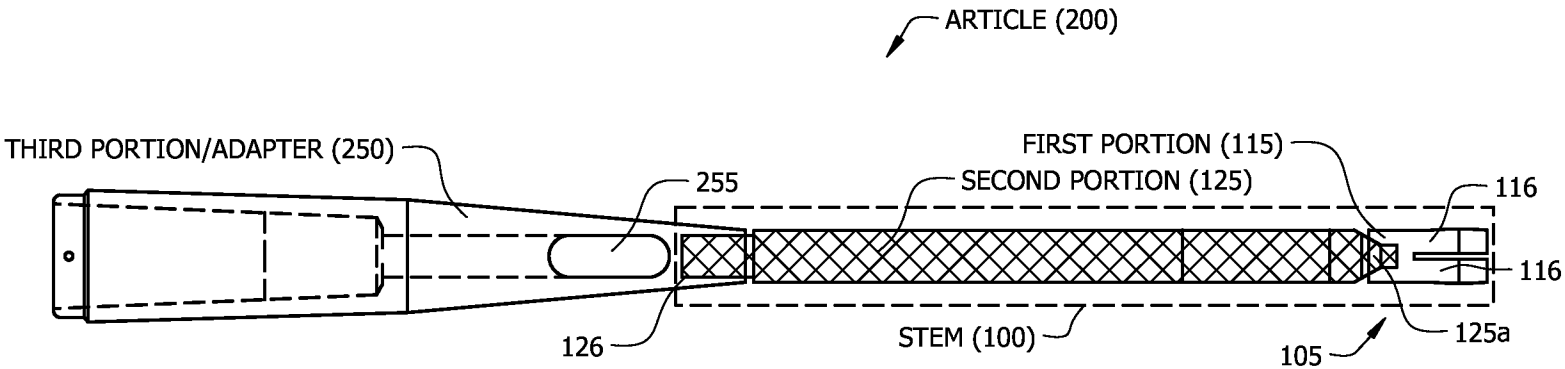
FIG. 2 is a see-through depiction of an example three-piece droop-resistant article comprising a third portion/adapter fitted on the stem shown in FIG. 1. for boresighting weapons, according to an example embodiment.

FIG. 2 shows a depiction of an example three-piece droop-resistant article 200 comprising a third portion/adapter 250 fitted on the coupling end 110 of the stem 100 shown in FIG. 1. Article 200 adds a third portion/adapter 250 to the second portion 125 of stem 100 and like first portion 115 comprises a material that is not largely tungsten carbide, such as at least primarily by weight aluminum, steel, or a stainless steel alloy such as 17-4 stainless steel. Third portion/adapter 250 is shown attached to the coupling end 110 of the second portion 125 by a mechanically joint, such as by a variety of methods including press fitting, welding, or soldering (e.g., silver soldering). The taper on third portion/adapter 250 provides an attachment feature which interfaces with the end of the barrel of the weapon, and may be coated with a thick coat chrome coating over the base material to improve abrasion resistance. Third portion/adapter 250 also has an elongated slot feature 255 that provides for use of a "drift key" to facilitate separating the third portion/adapter 250 from the stem 100 of the boresight.

Figure 3:
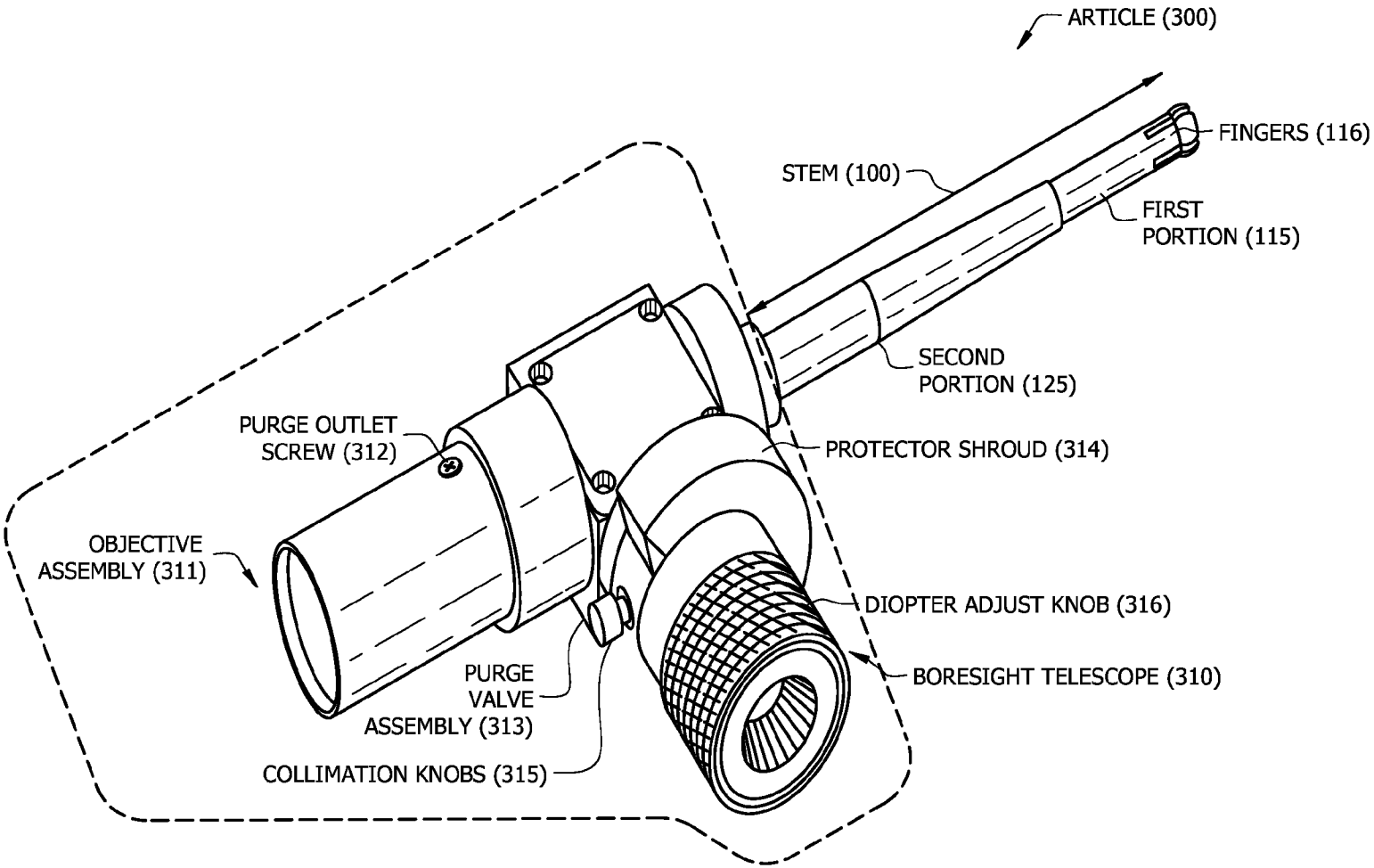
FIG. 3 is a depiction of an example article comprising the stem shown in FIG. 1 integrated with a boresight telescope for boresighting generally smaller caliber weapons, according to an example embodiment.

FIG. 3 is a depiction of an example article 300 comprising stem 100 integrated with a zeroing device shown as boresight telescope 310 for boresighting generally smaller caliber weapons, according to an example embodiment. In this embodiment the boresight telescope 310 is joined to the stem 100, such as by a standard machined threaded connection. A press fit, or an adhesive can also be used to make this connection. Boresight telescope 310 is shown comprising objective assembly 311, purge outlet screw 312, purge valve assembly 313, protector shroud 314, reticle adjustment (collimation) knobs 315, and diopter adjust knob 316.

Regarding the objective assembly 311, the objectives can have an aperture or f-stop that allows for a maximum amount of light into the respective systems allowing for good performance in low light conditions, rain, snow, dust, humidity, and nighttime use. The diopter adjust knob 316 allows the user to make adjustments for the best resolution per the individual's visual acuity. The flexible fingers 116 shown can be chromed and ground as needed, which as described above forms essentially a perfect circle inherently allowing the adapter to locate the mechanical centerline axis of the tube of the weapon. The reticle adjustment knobs 315 rotate to move the reticle in any direction from zero along the azimuth axis and elevation axis. The reticle adjustment knobs 315 provide a means of fine tuning the alignment of the mechanical centerline axis of the gun tube with the gunner's sight. The protector shroud 314 protects the reticle adjustment knobs 315 from being disturbed during storage or transport. The purge valve assembly 313 is used to fill optical chamber of telescope with a high purity gas, typically nitrogen, which can essentially eliminate internal moisture and by pushing moisture laden air out of boresight telescope 310.

Figure 4A:
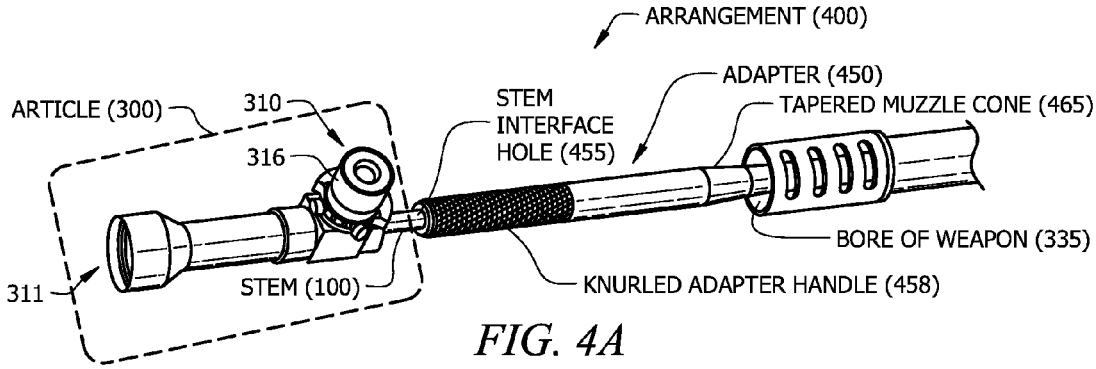
Figure 4B:
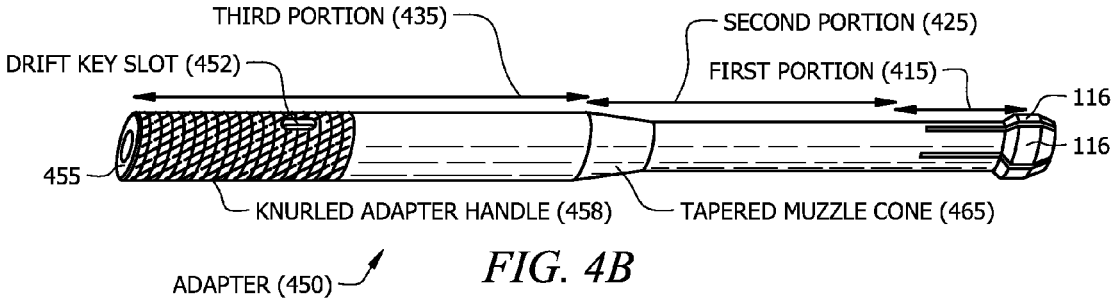
FIG. 4B is an expanded depiction of the adapter depicted in FIG. 4A.

FIG. 4A is a depiction of an example boresighting arrangement 400 comprising article 300 shown in FIG. 3 including stem 100 integrated with boresight telescope 310, where article 300 is locked in place with a droop-resistant adapter 450 that is inserted into the bore 335 of a weapon, for boresighting generally medium to larger caliber weapons, according to an example embodiment. FIG. 4B is an expanded depiction of the adapter 450 depicted in FIG. 4A. Analogous to first portion 115 and second portion 125 of stem 100, adapter 450 includes first portion 415 comprising a material that is not largely tungsten carbide, such as at least primarily by weight aluminum, steel, or a stainless steel alloy which includes flexible fingers 116, and a droop resistant second portion 425 in the region that would normally droop which comprises largely tungsten carbide.

Adapter 450 includes a stem interface hole 455 so that first portion 115 of stem 100 slides into stem interface hole 455 and can lock in place, such as via a Morse taper arrangement. As shown in FIG. 1, stem 100 includes a droop-resistant second portion 125 which includes attachment feature 126 opposite first portion 115. Adapter 450 includes a knurled adapter handle 458 and a tapered muzzle cone 465. knurled adapter handle 458 allows use with heavy (thick) protective gloves.

As shown in FIG. 4A, the stem of adapter 100 is a smaller size adapter (e.g., 7.62 mm) that is attached to the boresight telescope 310, which is inserted into adapter 450 that is a larger adapter, where the flexible fingers of the adapter 450 are positioned within the bore 335 of the weapon. The configuration of boresighting arrangement 400 depicted in FIG. 4A is generally used for boresighting a larger caliber weapon as compared to the adapter 300 alone as depicted in FIG. 3, such as for a 12.5 mm to 40 mm caliber weapon. There is also an application where a 7.62 mm stem 100 is connected to a smaller 5.56 mm adapter 450 fabricated as disclosed herein.

The tapered muzzle cone 465 can be hard chromed and then precision ground to essentially a perfect circle inherently allowing the adapter 450 to locate the mechanical centerline axis of the bore 335 of the weapon. It is the combination of the flexible fingers and the tapered muzzle cone 465 that locates the centerline. As the circle locates the mechanical centerline axis of the weapon's bore, an adjustable reticle can be used to fine tune for high accuracy. The reticle adjustment knobs 315 (collimation knobs 315 in FIG. 3) can be used to adjust the reticle position. Adapter 450 also includes a drift key slot 452. The stem 100 can be disengaged from the adapter 450 via the drift key slot 452.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

Thus, the breadth and scope of the subject matter provided in this Disclosure should not be limited by any of the above explicitly described embodiments. Rather, the scope of this Disclosure should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A stem or adapter for boresighting weapons, comprising:

a first portion having a weapon insertion end including a centering device comprising a plurality of fingers which compress upon insertion into a bore of a weapon, and a second portion having a first end attached to an end of said first portion opposite to said weapon insertion end, said second portion having a coupling end including an attachment feature opposite said first end for attaching another member thereto;

wherein said second portion comprises largely tungsten carbide, and wherein said first portion comprises a material that is largely not tungsten carbide.

2. The stem or adapter of claim 1, wherein said first end is attached to said coupling end by a press fit, weld, or solder joint.

3. The stem or adapter of claim 1, wherein said first portion comprises largely a steel or aluminum.

4. The stem or adapter of claim 1, wherein said attachment feature comprises a machine threading.

5. The stem or adapter of claim 1, further comprising a third portion attached to said attachment feature comprising a material that is largely not tungsten carbide.

6. The stem or adapter of claim 5, wherein said first portion and said third portion comprise largely a steel or aluminum.

7. The stem or adapter of claim 6, wherein said steel comprises stainless steel.

8. The stem or adapter of claim 1, wherein said plurality of fingers are equiangularly spaced fingers and extend to a distal end of said weapon insertion end.

9. A boresighting arrangement, comprising:

a stem or adapter comprising:

a first portion having a weapon insertion end including a centering device comprising a plurality of fingers which compress upon insertion into a bore of a weapon;

a second portion having a first end attached to an end of said first portion opposite to said weapon insertion end, said second portion having a coupling end including an attachment feature opposite said first end for attaching another member thereto, wherein said second portion comprises largely tungsten carbide, and wherein said first portion comprises a material that is largely not tungsten carbide, and a boresighting apparatus attached to said attachment feature.

10. The boresighting arrangement of claim 9, wherein said attachment feature comprises machined threading, and where an attachment of said boresighting apparatus to said attachment feature is a direct attachment.

11. The boresighting arrangement of claim 9, wherein said boresighting apparatus comprises a boresight telescope.

12. The boresighting arrangement of claim 9, wherein said first end is attached to said coupling end by a press fit, weld, or solder joint.

13. The boresighting arrangement of claim 9, wherein said stem or said adapter further comprises a third portion attached to said attachment feature comprising a material that is largely not tungsten carbide, and wherein said boresighting apparatus is attached indirectly to said attachment feature.

14. The boresighting arrangement of claim 9, wherein said plurality of fingers are equiangularly spaced fingers and extend to a distal end of said weapon insertion end.

* * * * *